US008240501B2

(12) United States Patent
Claydon

(10) Patent No.: US 8,240,501 B2
(45) Date of Patent: Aug. 14, 2012

(54) METHOD OF CONTROLLING IN-CAN PRESSURE DURING THERMAL PROCESSING

(75) Inventor: Paul Charles Claydon, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 960 days.

(21) Appl. No.: 10/562,027

(22) PCT Filed: Jun. 22, 2004

(86) PCT No.: PCT/EP2004/006723

§ 371 (c)(1),
(2), (4) Date: Dec. 22, 2005

(87) PCT Pub. No.: WO2005/005277

PCT Pub. Date: Jan. 20, 2005

(65) Prior Publication Data

US 2006/0151503 A1 Jul. 13, 2006

(30) Foreign Application Priority Data

Jul. 1, 2003 (EP) ..... 03254287

(51) Int. Cl.

| | |
|---|---|
| ***B65D 17/34*** | (2006.01) |
| ***B65D 41/00*** | (2006.01) |
| ***B65D 6/28*** | (2006.01) |
| ***B65D 8/04*** | (2006.01) |
| ***B65D 8/06*** | (2006.01) |
| ***B65D 51/12*** | (2006.01) |
| ***B65D 53/00*** | (2006.01) |

(52) U.S. Cl. ..... 220/359.2; 220/359.1; 220/609; 220/624; 220/213; 220/240

(58) Field of Classification Search ..... 220/359.1, 220/359.2, 609, 624, 276, 213, 240
See application file for complete search history.

(56) References Cited

U.S. PATENT DOCUMENTS 211,656 A 1/1879 Graves et al.
1,524,415 A 1/1922 Uphus
(Continued)

FOREIGN PATENT DOCUMENTS

EP 0 683 110 A1 11/1995
(Continued)

*Primary Examiner* — Anthony Stashick
*Assistant Examiner* — Andrew T Kirsch
(74) *Attorney, Agent, or Firm* — Miles & Stockbridge P.C.; David R. Schaffer, Esq.

(57) ABSTRACT

A closure for a food can including a foil end panel bonded to an intermediate ring which is fixed to the can body. The foil panel comprises a diaphragm having a centre panel which included at least one concentric bead. The profile of this beaded panel is selected so that its downward position is no greater than the lowest point of the intermediate ring. The provision of the bead(s) reduces pressure differences experienced by the diaphragm, particularly during processing of the can contents, due to the volume increase available from the beads.

6 Claims, 1 Drawing Sheet

U.S. PATENT DOCUMENTS

| | | | | | |
|---|---|---|---|---|---|
| 2,027,430 | A | * | 1/1936 | Hansen | 220/624 |
| 3,160,302 | A | | 12/1964 | Chaplin | |
| 3,606,509 | A | | 9/1971 | Bennett | |
| 3,930,592 | A | * | 1/1976 | DiIanni | 220/270 |
| 4,366,999 | A | | 1/1983 | Koncelik et al. | |
| 4,919,498 | A | | 4/1990 | Turner | |
| 5,725,120 | A | * | 3/1998 | Ramsey et al. | 220/276 |
| 5,804,237 | A | | 9/1998 | Diamond et al. | |
| 2002/0050493 | A1 | * | 5/2002 | Ball et al. | 220/359.2 |

FOREIGN PATENT DOCUMENTS

| | | |
|---|---|---|
| FR | 1287808 | 3/1962 |
| GB | 454429 | 9/1936 |
| WO | WO 03/006329 A2 | 1/2003 |

* cited by examiner

METHOD OF CONTROLLING IN-CAN PRESSURE DURING THERMAL PROCESSING

BACKGROUND OF THE INVENTION

This invention relates to a closure. In particular, it relates to a closure which includes a foil end panel for bonding to a container or, more usually, to an intermediate ring which can then be fixed to a container such as a metal can to close the can.

Such closures are typically intended for closing containers for food and are opened by peeling off the foil panel. The closure, or "peelable end" must be capable of maintaining seal integrity during processing, sterilisation etc. of the food without damage to the foil. However, the closure must also be capable of being readily opened by peeling off the foil panel for access to the food for consumption.

Conventionally, cans closed by peelable ends are processed in overpressure retorts, where in-can pressure generated additional to the vapour pressure of the steam (differential pressure) during the sterilisation process may be balanced by the introduction of air pressure. The use of retorts which do not offer use of overpressure ("non-overpressure retorts"), or higher volume throughput retorts such as hydrostatic and reel and spiral retorts which do not offer the overpressure facility is currently prevented by excessive doming of the foil panel, resulting in damage to the foil, by interference with guide rails.

Foil damage occurs particularly in the centre of the dome by interference with guide rails but may also arise when creasing of the foil from vacuum and pressure results in the development of pin holes and loss of seal integrity. A further problem when non-overpressure retorts are used is bursting of the seal around the foil panel due to excessive differential pressure.

This invention seeks to overcome these problems which currently prohibit the use of non-overpressure retorts.

According to the present invention, there is provided a closure for fixing to an open end of a container body, the closure comprising a diaphragm bonded to an annular component, the diaphragm having a centre panel which includes at least one concentric bead such that when the closure is fixed to a container and subjected to pressure differentials, the diaphragm is deflectable outwardly to give an increase in container volume, and in which the profile of the diaphragm beaded panel is selected so that its downward form extends at most to the lowest plane of the annular component.

The provision of beads or "corrugations" reduces the pressure difference "seen" by the diaphragm due to the volume increase available from the corrugations.

Preferably, the maximum upward displacement is no greater than the height of a seaming panel of the annular component. This enables the closure to be used where processing using reel and spiral retorts is necessary.

The closure of the invention thus cannot rely on process pressure alone to stretch the foil panel and provide a suitable volume increase for controlling in-can pressure. Instead, the closure of the invention has the stretch introduced into the panel prior to processing, by the provision of the beaded profile. The process pressure differentials therefore simply deflect the beaded profile into a generally domed shape, thereby providing the required volume increase.

In one embodiment, the diaphragm is bonded to a panel of the annular component, this bonding panel extending radially outwardly and downwardly at an angle of 10° to 20° to the horizontal. By increasing the angle of the bonding panel to a greater angle than the angle subtended by the extremity of the foil panel in its outwardly domed position, the bond only undergoes shear loading which effectively doubles burst pressure performance from that of standard ends which are loaded in peel mode.

Typically, at processing temperatures (e.g. 129° C.), the burst pressure of a 73 mm diameter end in peel mode is around 0.3 bar, which increases to approximately 0.6 bar when the angle is increased. Angles of greater than 20°, up to 60° are possible within the scope of the invention so as to provide additional burst pressure performance for domes of greater deflection, but the diaphragm may then become unpeelable unless the panel angle is reduced after processing. Realistically, bonding panel angles of up to 45° give sufficient dome size (i.e. maximum deflection).

Typically, the annular component is a metal ring adapted for seaming to a metal can body. The term "annular" is used herein to include both circular and irregular rings. For example, the annular component may be used with a cuboid container, such as are commonly used for packaging fish. When the closure is used in combination with a cylindrical container, the container preferably has a side wall height which is less than the diameter of the container.

Since the diaphragm deflects outwardly to control the in-can pressure that can be accommodated by the seal burst pressure resistance, an increase in can volume approximately equal to the thermal expansion of a product in the can and any gases in the headspace is obtained. An aspect ratio for a cylindrical container in which the can height is less than its diameter provides sufficient expansion from the diaphragm for the associated can volume.

According to another aspect of the present invention, there is provided a method of controlling in-can pressure during thermal processing, comprising: bonding a panel to an inclined seal surface of an annular component; stretching the panel; fixing the annular component and panel bonded thereto to a filled can; and processing the contents of the filled and closed can by heating to temperatures of up to 135° C.; and providing, at least during the processing step, a generally dome shaped profile to the panel so as to provide an increase in can volume approximately equal to thermal expansion of the contents and gases in any headspace within the can.

Preferably, the method further comprises stretching the panel into a beaded profile which matches the fibre length of the generally domed shaped profile provided during thermal processing.

The inclined seal surface of the annular component may be initially at an angle of from 10° to 60° and the method may further comprise reforming the seal surface to a shallower angle, or even 0°, after the processing step. In this way, higher angles would be available during processing so that the bond only undergoes shear (not peel) loading and the angle is decreased for end user ease of opening.

A preferred embodiment of the invention will now be described, by way of example only, with reference to the drawings, in which:

DETAILED DESCRIPTION OF THE PREFERRED EMBODIMENTS

Figure 1:
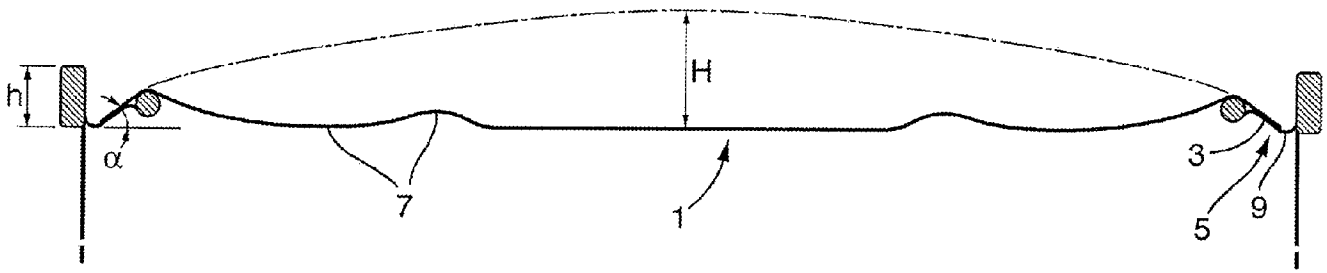
FIG. 1 is a schematic side view of a foil panel bonded to a metal ring.

In FIG. 1, a diaphragm comprising a foil panel 1 is fixed by bonding to an inclined panel 3 of a metal ring 5. Bonding panel 3 has a curled inner edge and is inclined in the example at an angle $\alpha$ (alpha) of 15°.

The profile of the undeflected diaphragm 1 is shown in solid line. This profile extends downwardly from the bonding panel 3 into corrugations 7. The number of corrugations is selected such that no part of the diaphragm extends below the plane of the lowest point of the metal ring (here shown at 9) for ease of handling and without risk of damage during seaming to a can body. The corrugation provide sufficient stretch to accommodate in-can pressure without exceeding maximum burst pressure. Minimal internal pressure is required for the beaded profile to "flip" outwardly to a domed form, this form still being capable of handling without additional risk of damage.

Figure 2:
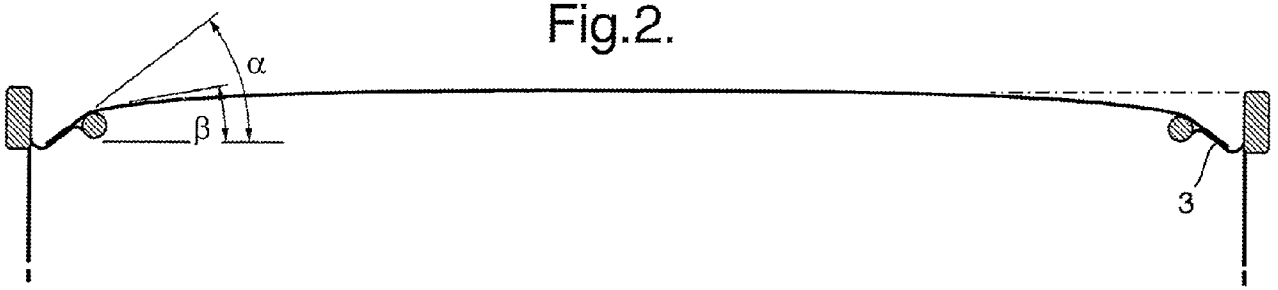
FIG. 2 is a schematic side view of the deflected foil panel.

In FIG. 2, it can be seen that the seal surface is inclined at angle $\alpha$ (alpha) which is greater than the foil tangent angle $\beta$ (beta). This eliminates the peel component and maximises bond failure pressure.

The highest point of the dome in FIG. 2 lies below the top of the seaming panel/double seam for use in a reel and spiral cooker. Where standard non-overpressure retorts are used, this is not an issue and the fully deflected profile of the foil panel diaphragm as shown by a dotted line in FIG. 1 may have a height H which exceeds the seaming panel/double seam height h.

Although a preferred embodiment of the invention has been specifically illustrated and described herein, it is to be understood that minor variations may be made in the apparatus without departing from the spirit and scope of the invention, as defined by the appended claims.

The invention claimed is:

1. A method of controlling in-can pressure during thermal processing, comprising:

bonding a panel to an inclined seal surface of an annular component, the inclined seal surface of the annular component being initially at an angle of from 10° to 60°;

stretching the panel;

fixing the annular component and panel bonded thereto to a filled can;

processing the contents of the filled and closed can by heating to temperatures of up to 135° C.; and providing, at least during the processing step, a generally dome shaped profile to the panel so as to provide an increase in can volume approximately equal to thermal expansion of the contents and gases in any headspace within the can; and reforming the seal surface to a shallower angle than the initial angle of the seal surface down to and including 0° after the processing step.

2. The method as defined in claim 1, further comprising stretching the panel into a beaded profile which matches the fibre length of the generally domed shaped profile provided during thermal processing.

3. A method of controlling in-can pressure during thermal processing, comprising:

bonding a panel to an inclined seal surface of an annular component, the inclined seal surface of the annular component being initially at an angle of from greater than 20° up to 60°;

stretching the panel;

fixing the annular component and panel bonded thereto to a filled can;

processing the contents of the filled and closed can by heating to temperatures of up to 129° C.; and providing, at least during the processing step, a generally dome shaped profile to the panel so as to provide an increase in can volume approximately equal to thermal expansion of the contents and gases in any headspace within the can; and reducing the seal surface angle to a shallower angle than the initial angle of the seal surface after the processing step.

4. The method as defined in claim 3, further comprising stretching the panel into a beaded profile which matches the fibre length of the generally domed shaped profile provided during thermal processing.

5. The method as defined in claim 3 wherein the inclined seal surface of the annular component is initially at an angle of from 20° up to 45°.

6. The method as defined in claim 4 wherein the inclined seal surface of the annular component is initially at an angle of from 20° up to 45°.

* * * * *